United States Patent [19]

Mizuno et al.

[11] Patent Number: 4,615,378

[45] Date of Patent: Oct. 7, 1986

[54] REGENERATOR

[75] Inventors: Tomokimi Mizuno, Chiryu; Kazuaki Yamaguchi, Kariya, both of Japan

[73] Assignee: Aisin Seiki Kabushiki Kaisha, Kariya, Japan

[21] Appl. No.: 778,683

[22] Filed: Sep. 23, 1985

[30] Foreign Application Priority Data

Sep. 28, 1984 [JP] Japan ..... 59-201435

[51] Int. Cl.[4] ..... F28D 17/02

[52] U.S. Cl. ..... 165/10; 165/4

[58] Field of Search ..... 165/10, 4

[56] References Cited

U.S. PATENT DOCUMENTS 3,445,910 5/1969 Duryee et al. ..... 165/4

FOREIGN PATENT DOCUMENTS 117995 7/1983 Japan ..... 165/10

OTHER PUBLICATIONS

Japanese Technical Paper, Kazuhiro Hamaguchi, Shintaro Takahashi and Hideya Miyabe of the Japanese Mechanics Society, Book B, vol. 248, No. 435, Nov., 1982, at pp. 2207–2216.

*Primary Examiner*—Albert W. Davis, Jr.

*Attorney, Agent, or Firm*—Burns, Doane, Swecker and Mathis

[57] ABSTRACT

A regenerator includes a cylindrical body and a plurality of improved wire mesh screens stacked inside the cylindrical body. Each wire mesh screen includes a number of interwoven wires that overlap one another at the cross points of the wire mesh screen, with the overlapping wires being compressed at the cross points in the direction in which the wire mesh screens are stacked. This shortens the distance between the central axes of the overlapping wires at the cross points in the stacking direction so that a greater number of the wire mesh screens may be stacked in the cylinder.

2 Claims, 5 Drawing Figures

REGENERATOR

BACKGROUND OF THE INVENTION

This invention relates to a heat regenerator and more particularly to a heat regenerator of the type arranged between the expansion space and compression space of a heat gas engine such as a stirling cycle engine to effect thermal regeneration.

To operate a regenerator at a high performance, it is required not only that the materials to be used have a high thermal capacity but also that the regenerator have a large specific surface area, namely a large heat transfer or conductive surface area per unit volume, a smaller dead volume internally of the regenerator, and little fluidic resistance. For this purpose, Book B, Vol. 248, No. 435 of the technical papers of the Japan Mechanics Society (November, 1982) describes a regenerator structure comprising a cylindrical body and a number of wire mesh screens stacked in the cylindrical body and consisting of wires made of copper or SUS-27.

With the wire mesh screens used in a conventional regenerator, thermal capacity, specific surface area, dead volume and fluidic resistance naturally are decided by the number of stacks of wire mesh screens in the regenerator, the wire mesh material, the number of meshes and the wire diameter. To increase thermal capacity and specific surface area, therefore, one possible approach is to enlarge the size of the wire mesh screens and increase the number of stacks thereof, and another is to reduce wire diameter and increase the number of meshes. However, the former increases dead volume, and the latter raises fluidic resistance by decreasing the degree of pore opening of the meshes. The end result in either case is a failure to improve regenerator performance.

SUMMARY OF THE INVENTION

Accordingly, an object of the present invention is to provide a regenerator the peformance of which is improved by reducing dead volume and increasing specific surface area without raising fluidic resistance.

According to the present invention, the foregoing object is attained by providing a regenerator comprising a cylindrical body and a plurality of wire mesh screens stacked inside the cylindrical body. Each wire mesh screen includes longitudinally and transversely extending wires of generally circular cross section woven into a mesh. The wires overlap each other at the cross points of the mesh, with the overlapping portions of the wires being compressed in the stacking direction to locally flatten their cross sections at the cross points and, hence, to reduce the distance between the central axes of the overlapping wires. This allows a greater number of the wire mesh screens to be stacked in the cylindrical body, thus enabling an increase in specific surface area and a reduction in dead volume without raising fluidic resistance.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 2:
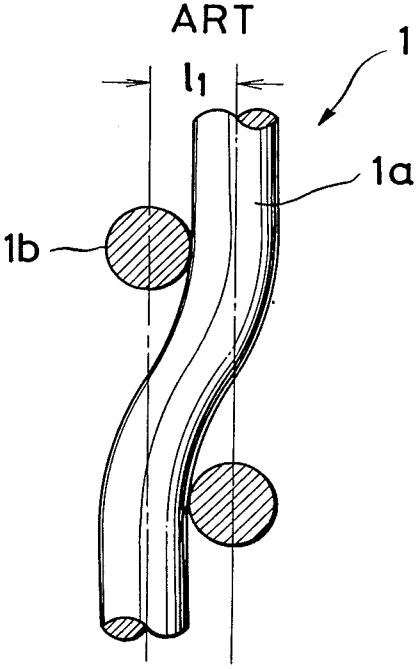
FIG. 2 PRIOR ART
FIG. 2 is a side view, partially in section, showing the conventional wire mesh screen of FIG. 1.
Figure 1:
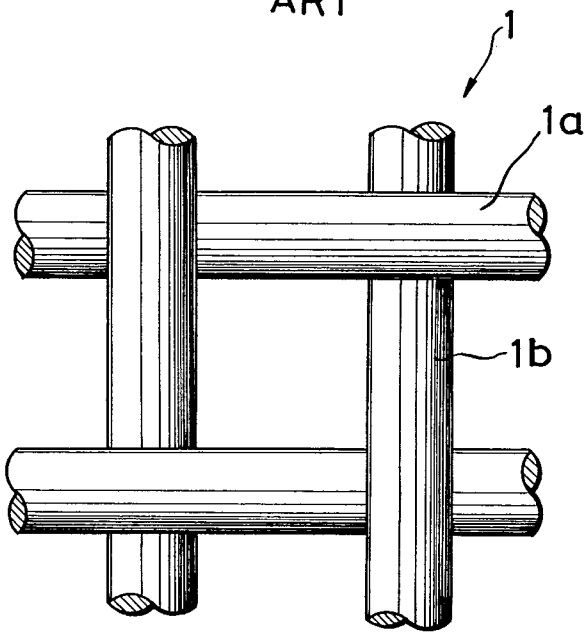
FIG. 1 PRIOR ART
FIG. 1 is a partial plan view illustrating a portion of a conventional wire mesh screen employed in a regenerator according to the prior art.

Before describing an embodiment of the present invention in detail, let us refer to FIGS. 1 and 2 for a review of the art to which the present invention appertains in order to grasp and understand the principle of the invention.

FIGS. 1 and 2 show a portion of a conventional wire mesh screen 1 a number of which are stacked in a cylindrical body. It will be seen in the side view of FIG. 2 that the longitudinally and transversely extending wires 1*a*, 1*b* constituting each screen 1 overlap each other, and that the distance in the stacking direction between the central axes of the wires 1*a*, 1*b* where they overlap is $l_1$.

The inventors have given special attention to the dimension $l_1$ and have discovered that this dimension makes it possible to be shortened, with a regenerator of the same volume, to increase the number of wire mesh screens in the stack, reduce dead volume and enlarge specific surface area without raising fluidic resistance. Based on this discovery, the inventors have developed a regenerator having an improved wire mesh screen in which the overlapping portions of the wire constituting the wire mesh screen are compressed in the stacking direction to reduce the distance between the central axes of these overlapping wires in the stacking direction.

Figure 3:
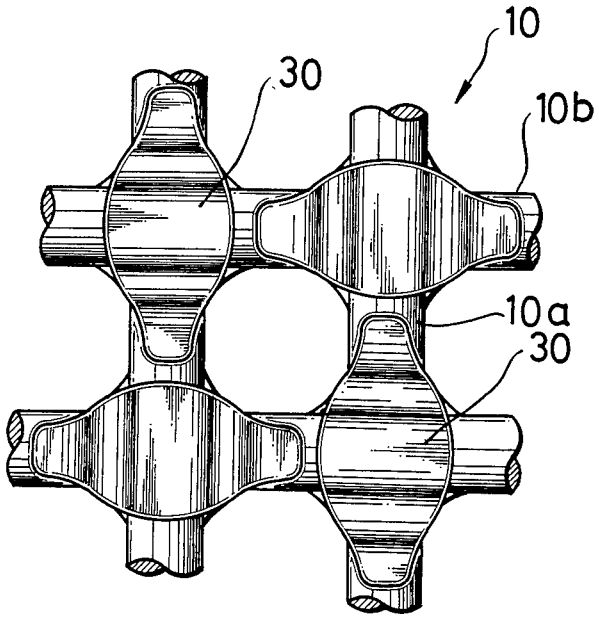
FIG. 3 is a partial plan view illustrating a portion of a wire mesh screen employed in a regenerator according to the present invention.
Figure 4:
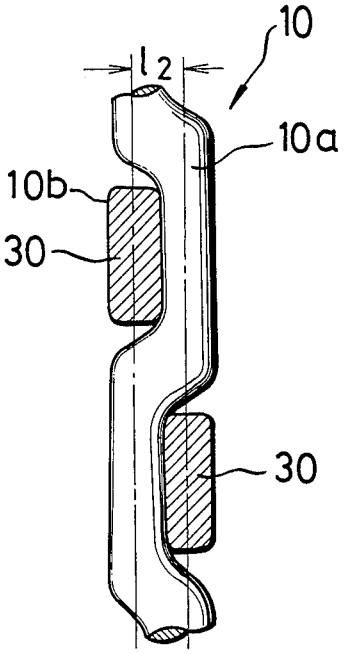
FIG. 4 is a side view, partially in section, showing the wire mesh screen of FIG. 4.
Figure 5:
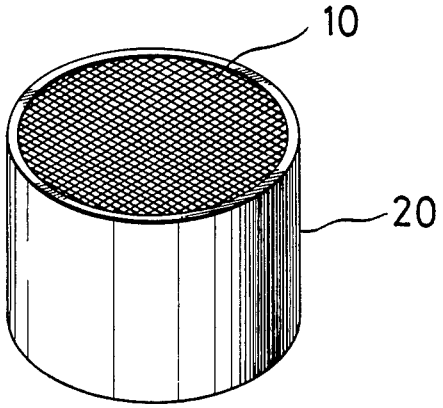
FIG. 5 is a perspective view of a regenerator according to the present invention.

An embodiment of the present invention adopting the foregoing principle is illustrated in FIGS. 3 and 4. A wire mesh screen 10, a number of which are stacked axially in a cylindrical body 20 shown in FIG. 5, comprises longitudinally and transversely extending wires 10*a*, 10*b* of generally circular cross section woven into a mesh. The wires 10*a*, 10*b* overlap each other at the cross points of the mesh, as best seen in FIG. 3. The overlapping portions of the wires 10*a*, 10*b* are subjected to a compressive force applied by a roll to compress these portions in the stacking direction, whereby each overlapping portion is deformed from the generally circular cross section to one which is generally rectangular, as shown in FIG. 4. The overlapping portions of the wires 10*a*, 10*b* thus deformed have flattened surfaces, which are designated at numeral 30. The result is to reduce the distance between the central axes of the overlapping wires 10*a*, 10*b* from $l_1$ (FIG. 2) to $l_2$, shown in FIG. 4.

It will be appreciated from FIG. 3 that compressing the overlapping portions of the wires 10*a*, 10*b* to form the flattened surfaces 30 has almost no effect upon the degree of pore opening and, hence, does not increase fluidic resistance. Shortening the dimension $l_2$ does, however, have the advantageous effect of allowing a greater number of the wire mesh screens 10 to be stacked in the cylindrical body 20, thus enabling an increase in specific surface area and a reduction in dead volume without raising fluidic resistance.

Rather than applying a roll to the wire mesh screen following its fabrication, it is possible to shape those portions of individual wires that will eventually overlap into a rectangular or oval cross section in advance and then weave the wires into a mesh in such a manner that the portions so reduced in cross section overlap.

As many apparently widely different embodiments of the present invention can be made without departing from the spirit and scope thereof, it is to be understood that the invention is not limited to the specific embodiments thereof except as defined in the appended claims.

What is claimed is:

1. A regenerator comprising:

a cylindrical body; and a plurality of wire mesh screens stacked inside said cylindrical body;

each wire mesh screen including a number of interwoven wires which overlap one another at cross points of the wire mesh screen, the overlapping wires being compressed at said cross points in a direction in which said wire mesh screens are stacked, whereby a distance between central axes of respective ones of the overlapping wires at said cross points is shortened in said direction.

2. A regenerator according to claim 1, wherein the compressed wire portions each has flattened surface and a rectangular or oval cross section.

* * * * *